US011828094B1

(12) United States Patent
Kistner

(10) Patent No.: US 11,828,094 B1
(45) Date of Patent: Nov. 28, 2023

(54) SECURITY SYSTEM FOR DOORS

(71) Applicant: David Kistner, Midlothian, TX (US)

(72) Inventor: David Kistner, Midlothian, TX (US)

( * ) Notice: Subject to any disclaimer, the term of this patent is extended or adjusted under 35 U.S.C. 154(b) by 125 days.

(21) Appl. No.: 16/999,269

(22) Filed: Aug. 21, 2020

(51) Int. Cl.
*E05C 19/00* (2006.01)
*E05C 19/18* (2006.01)
*E05B 17/20* (2006.01)
*E05B 65/00* (2006.01)

(52) U.S. Cl.
CPC ..... *E05C 19/003* (2013.01); *E05B 17/2092* (2013.01); *E05B 65/0003* (2013.01); *E05C 19/188* (2013.01)

(58) Field of Classification Search
CPC ..... E05C 19/00; E05C 19/004; E05C 19/007; E05C 19/184; E05C 19/186; E05C 19/003; E05C 19/188; E05C 292/288; E05C 292/289; E05C 292/30; E05C 19/18; E05C 7/00; E05C 17/047; E05B 63/0004; E05B 65/0075; E05B 65/0082; E05B 17/2092; E05B 65/0003; E05B 65/0894; Y10T 292/20; Y10T 292/228; Y10T 292/23; Y10T 292/237; Y10T 292/34; Y10T 292/37; Y10T 292/373; Y10T 292/376; Y10T 292/379; Y10T 292/382; Y10T 292/385; Y10T 292/388; Y10T 292/391; Y10T 292/394; Y10T 292/397; Y10T 292/67; Y10T 292/65; Y10T 292/71; Y10T 292/73; Y10S 292/65; Y10S 292/15; Y10S 292/19; Y10S 292/60
See application file for complete search history.

(56) References Cited

U.S. PATENT DOCUMENTS

| | | | | |
|---|---|---|---|---|
| 313,942 | A | 3/1885 | Knauer | |
| 2,536,941 | A | 1/1951 | Jones | |
| 3,321,229 | A | 5/1967 | Eckel | |
| 3,383,130 | A * | 5/1968 | De Avila | E05B 65/1066 292/288 |
| 4,322,104 | A * | 3/1982 | Matthews, Jr. | E05B 65/1066 292/288 |
| 5,077,940 | A * | 1/1992 | LaRose, Jr. | E05C 19/003 292/259 R |
| 5,209,533 | A * | 5/1993 | Menard | E05C 19/18 292/288 |
| 5,253,908 | A | 10/1993 | Leonard | |
| 5,496,081 | A * | 3/1996 | Rice | E05C 19/188 292/259 R |

(Continued)

FOREIGN PATENT DOCUMENTS

| | | | | |
|---|---|---|---|---|
| CA | 2084210 A | * | 6/1994 | E05B 65/0085 |
| CN | 206785116 U | | 12/2017 | |

*Primary Examiner* — Kristina R Fulton
*Assistant Examiner* — James Edward Ignaczewski
(74) *Attorney, Agent, or Firm* — James E. Walton

(57) ABSTRACT

A door security device has a rail support including a top surface and a bottom surface. A door support is attached to the rail support, such that the door support extends vertically away from the rail support of the door security device. The door support is oriented at a normal relative to the rail support. The bottom surface of the rail support rests parallel to a surface of a rail of a crash bar when the bottom surface is situated adjacent the surface of the rail. The security device creates a rigid connection to prevent unwanted removal of the door from a closed position.

9 Claims, 8 Drawing Sheets

(56) References Cited

U.S. PATENT DOCUMENTS

| | | | | |
|---|---|---|---|---|
| 5,622,397 | A * | 4/1997 | Rice | E05C 19/003 292/259 R |
| 5,623,841 | A | 4/1997 | Deemar | |
| 6,560,925 | B1 * | 5/2003 | Rice | E05C 19/188 292/259 R |
| 6,578,248 | B1 * | 6/2003 | Boldizar | B25B 11/007 269/21 |
| 6,860,528 | B2 | 3/2005 | O'Brien | |
| 11,391,068 | B2 * | 7/2022 | Harris | E05B 13/00 |
| 2004/0070215 | A1 | 4/2004 | Marsh et al. | |
| 2009/0165508 | A1 * | 7/2009 | Sprague | E05B 65/0025 70/91 |
| 2018/0106071 | A1 * | 4/2018 | Ivy | E05C 19/186 |
| 2019/0330893 | A1 | 10/2019 | Jones | |

* cited by examiner

SECURITY SYSTEM FOR DOORS

BACKGROUND

1. Field of the Invention

The present application relates to security devices. In particular, the present application relates to portable security devices for doors.

2. Description of Related Art

In recent years, emergency situations, such as flooding, hurricanes, earthquakes, fires, shooters, and so forth, resulted in the doors of high-occupancy structures or commercial buildings, such as churches, museums, theaters, and auditoriums, being fitted with crash bars or panic bars to enable mass-exiting. These crash bars are typically horizontal push-handles located at about waist height on the door, so that a user can quickly and easily open the door without having to locate and manipulate a small handle. Crash bars allow people to exit through the doors, even in an emergency or panic situation. Now, most commercial buildings are mandated by local ordinances, commercial codes, or industry standards to use doors with crash bars.

Currently, security devices are employed to prevent, deny, or delay access to intruders. For example, when these buildings experience an emergency situation involving intruders, the doors are locked. The doors may be equipped with pin and tumbler, magnetic, or electronic keypad locking mechanisms. Unfortunately, these buildings often have a hierarchy or built-in security system, where only qualified employees or security officers have the codes, keys, or key cards for opening, locking, or securing the premises. During power outages magnetic or electronic door locks may even cease functioning altogether. Foreseeing potential harm due to unwanted intruders, security officers are being posted at key entry points in these high-occupancy buildings to ensure lockdown may be achieved despite unforeseen circumstances. However, security officers are expensive, and many of these buildings, such as museums and churches, have limited budgets, preventing the use of twenty-four hour guards. Even when budgeting is not an issue, crash bars that utilize magnetic locking systems may be prevented from locking and/or unlocking when the power is down or has been deliberately disabled by an intruder.

Most often, in situations where an intruder is determined to enter a building, it is not possible to prevent the intruder from eventually getting inside. However, the longer that a security system can keep the intruder outside of the building, the longer the occupants of the building have to escape, seek more permanent shelter inside the building, or pursue defensive strategies. Thus, security measures that delay the intruder from entering the building are greatly desired.

Although the aforementioned methods of securing high-occupancy structures and commercial buildings represent great strides in the area of door security, many shortcomings remain.

DESCRIPTION OF THE DRAWINGS

The novel features believed characteristic of the present application are set forth in the appended claims. However, a preferred mode of use and certain objectives and advantages thereof, will best be understood by reference to the following detailed description when read in conjunction with the accompanying drawings, wherein:

DETAILED DESCRIPTION OF THE PREFERRED EMBODIMENT

Figure 1:
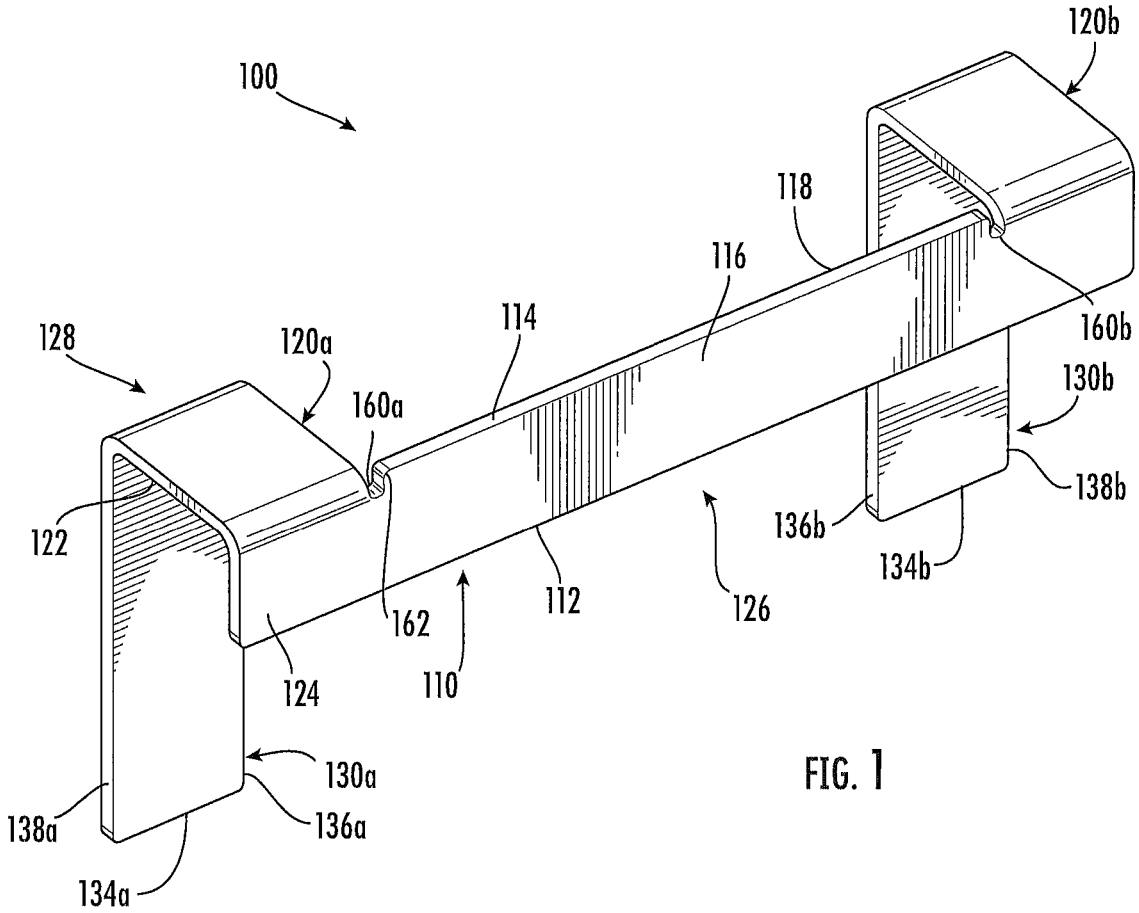
FIG. 1 is an isometric view of a security device for doors according to the preferred embodiment of the present application.
Figure 2:
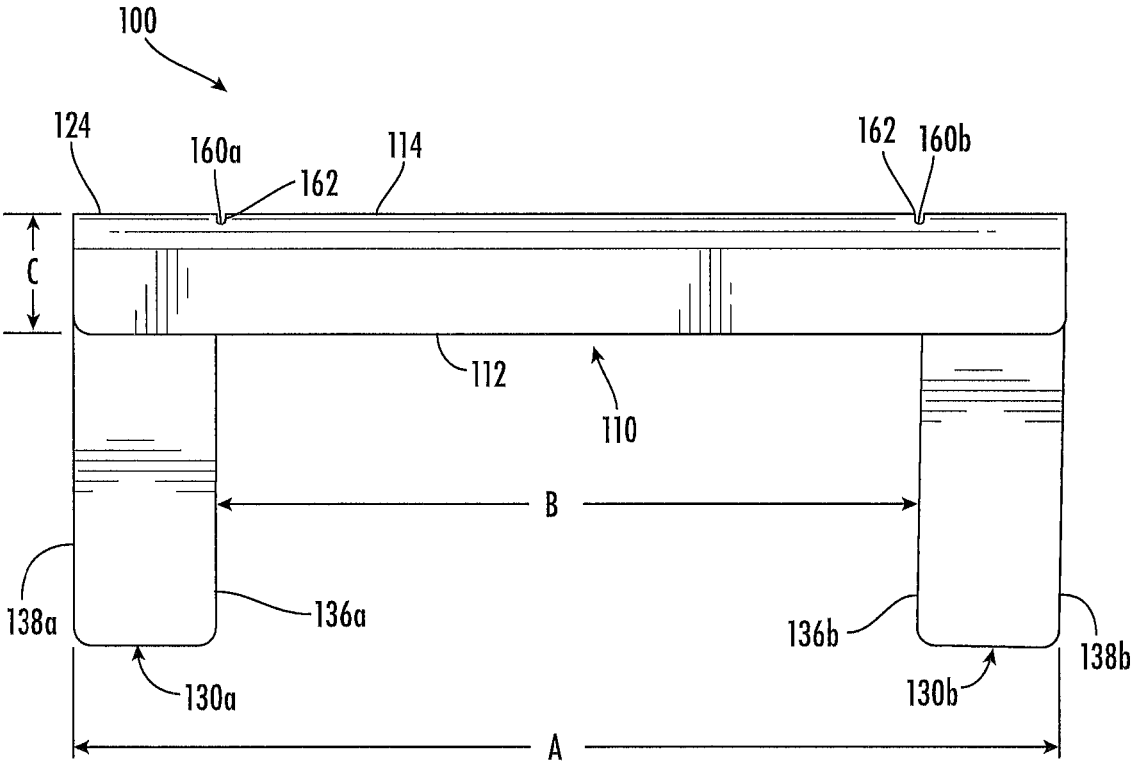
FIG. 2 is a front view of the security device for doors of FIG. 1.
Figure 3:
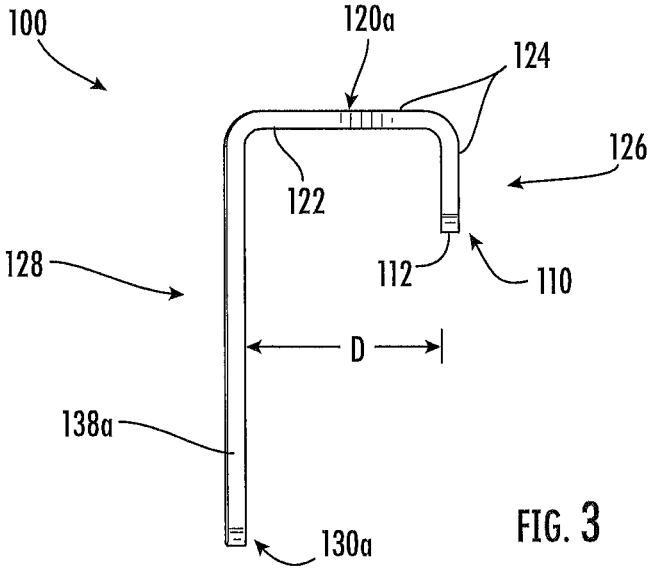
FIG. 3 is a left side view of the security device for doors of FIG. 1.

Referring to FIGS. 1-3 in the drawings, a security device for doors 100 is illustrated. Security device 100 has a front bar 110, rail supports 120*a* and 120*b*, and door tabs 130*a* and 130*b*. Front bar 110, rail supports 120*a* and 120*b*, and door tabs 130*a* and 130*b* are preferably formed from a metallic material, preferably aluminum or aluminum alloys, steel, carbon steel, stainless steel, nickel steel, chromium steel, or similar steel alloys, or other strong, rigid materials, including composite materials, that is cut, bent, welded, molded, and/or otherwise formed into the general shape depicted in FIG. 1.

Front bar 110 is preferably rectangular in shape, having a bottom edge 112, a top edge 114, a front surface 116, and a rear surface 118. Rail supports 120*a* and 120*b* are connected to top edge 114 at opposing ends of front bar 110 and extend in a rearward direction from front bar 110. Door tabs 130*a* and 130*b* are connected to the rear edges of rail supports 120*a* and 120*b*, respectively, and extend in a downward direction from rail supports 102*a* ad 120*b*. As is shown, door tabs 130*a* and 130*b* preferably extend a distance downward past bottom edge 112. As explained in more detail below, this ensures an adequate resistant force against the door when security device 100 is installed and in operation.

Although it is preferred that front bar 110 and rail supports 120*a* and 120*b* are integrally formed, front bar 110 may be moveable relative to, or removable from, either fully or in a restricted fashion, rail supports 120*a* and 120*b*. For example, front bar 110 may be attached to rail supports 120*a* and 120*b* via one or more hinge members or other connection members, such that front bar 110 may be angularly displaced. Such a configuration allows front bar 110 to serve as a lip for a crash bar, or to allow actuation of the crash bar from inside the door, when a user presses against front bar 110.

Door supports 130*a* and 130*b* have interior edges 136*a* and 136*b*, exterior edges 138*a* and 138*b*, and bottom edges 134*a* and 134*b*, respectively. Exterior edges 138*a* and 138*b* transition into bottom edges 134*a* and 134*b* via smooth curves. Likewise, bottom edges 134*a* and 134*b* transition into interior edges 136*a* and 136*b* via smooth curves.

The width of front bar 110 between the exterior edges 138*a* and 138*b* of door supports 130*a* and 130*b* is represented as distance A. The distance between interior edges 136*a* and 136*b* of door tabs 130*a* and 130*b* is represented as distance B. The distance from bottom edge 112 to top edge 114 is represented as C. The distance from rear surface 118 of front bar 110 to the front surface of door tabs 130*a* and 130*b* is represented as distance D.

Figure 4:
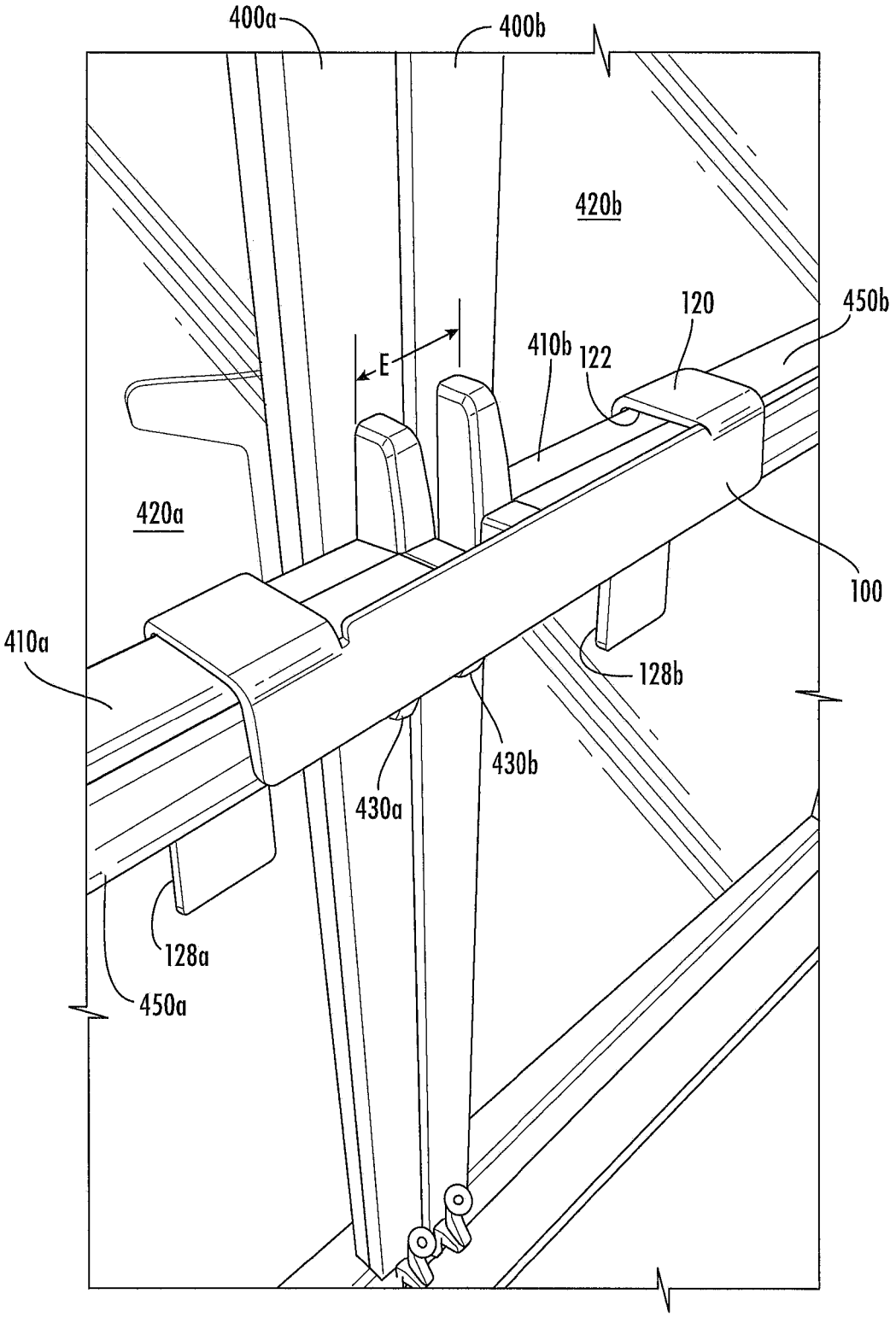
FIG. 4 is a perspective view of the security device for doors of FIG. 1 shown installed on a set of glass doors having crash bars.

Referring now also to FIG. 4 in the drawings, it will be appreciated that distance D may vary depending on the dimensions of the door, or the components of a crash bars 410*a* and 410*b* on which security device 100 is placed. For example, protruding screws, door locks, mounts, or housings on crash bars may be positioned on the right or left side of the door handles. In embodiments intended to position a security device 100 over a rail and a protruding crash bar assembly part, the distance, D, will be greater than the width dimension of the rail of the crash bar. Alternatively, the width dimension, D, is commensurate with the protruding width of the rail of the crash bar extending from the door. In at least one embodiment, the distance, D, is commensurate to the width of the rail together with a width of a depressed push bar.

In the preferred embodiment, security device 10 if formed by bending an planar piece of aluminum. As such, front bar 110 may be curved to create a smooth transition to rail supports 120*a* and 120*b*. Likewise, rail supports 120*a* and 120*b* may be curved to create a smooth transition to door tabs 130*a* and 130*b*. Furthermore, front bar 110 may be curved over portions of its surface area, or about its perimeter, to create a smooth and aesthetically pleasing front portion of security device 100. In alternative embodiments, angles, corners, perimeters, and surface areas may be squared. In other alternative embodiments, front bar 110 and/or door supports 120*a* and 120*b* may be shaped to conform to the shape of the crash bar of the door. First and second notches 160*a* and 160*b* are optional and extend past a lip 162 of front bar 110. First and second notches 160*a* and 160*b* provide stress relief from bending during the manufacturing process.

As shown in FIG. 4 in the drawings, security device 100 is shown installed in an operative mode on a pair of double doors 400*a* and 400*b*. Doors 400*a* and 400*b* include door handles 430*a* and 430*b* and push bars, or crash bars 450*a* and 450*b*, having top surfaces 410*a* and 410*b*, respectively. Doors 400*a* and 400*b* include panels 420*a* and 420B, respectively. Panels 420*a* and 420*b* are typically glass, but may be wood, metal, composite, or any other suitable material, or combination thereof. Typically, a small clearance, or offset, exists between glass panels 420*a* and 420*b* and crash bars 450*a* and 450*b*. In the operative mode, security device 100 is placed over crash bars 450*a* and 450*b*, such that door tabs 130*a* and 130*b* extend down in the clearance between glass panels 420*a* and 420*b*, respectively, and rail supports 120*a* and 120*ba* rest on top surfaces 410*a* and 410*b* of crash bars 450*a* and 450*b*, respectively.

As illustrated, door handles 430*a* and 430*b* are separated by a distance E. Industry standards or common commercial practice define distance E. In practice and/or during manufacturing, distance B is chosen dependent on distance E. For example, distance E may be determined based upon a pair of doors utilizing a center post, and distance B may be just larger than distance E, thereby allowing security device 100 to slide relative to door handles 430*a* and 430*b*. By way of another example, distance E may be determined based upon a pair of doors utilizing actuating rods that span a height of the door, and security device 100 may be manufactured such that distance B is slightly larger than distance E.

When security device 100 is installed as shown in FIG. 4, doors 400*a* and 400*b* cannot be easily opened. Indeed, an intruder must break glass 420*a* or 420*b* in order to remove security device 100 and open doors 400*a* and 400*b*. In this manner, security device 100 acts as a deterrent and provides a valuable time delay for occupants inside to escape, seek additional shelter, and/or pursue defensive strategies.

In alternative embodiments, door tabs 130 may include additional attachments, tabs, or rotating locking mechanisms that rotate relative to either crash bars 450*a* or 450*b*, or door handles 430*a* or 430*b*, to further prevent security device 100 from being removed despite excessive, repetitive blows to doors 400*a* and 400*b*.

Also, it will be appreciated that security device 100 may be installed from above crash bars 450*a* and 450*b* or below. If installed from below crash bars 450*a* and 450*b*, then a simple retaining mechanism, such as a tab or clip could utilized to retain security device 100 on crash bars 450*a* and 450*b*.

Figure 5:
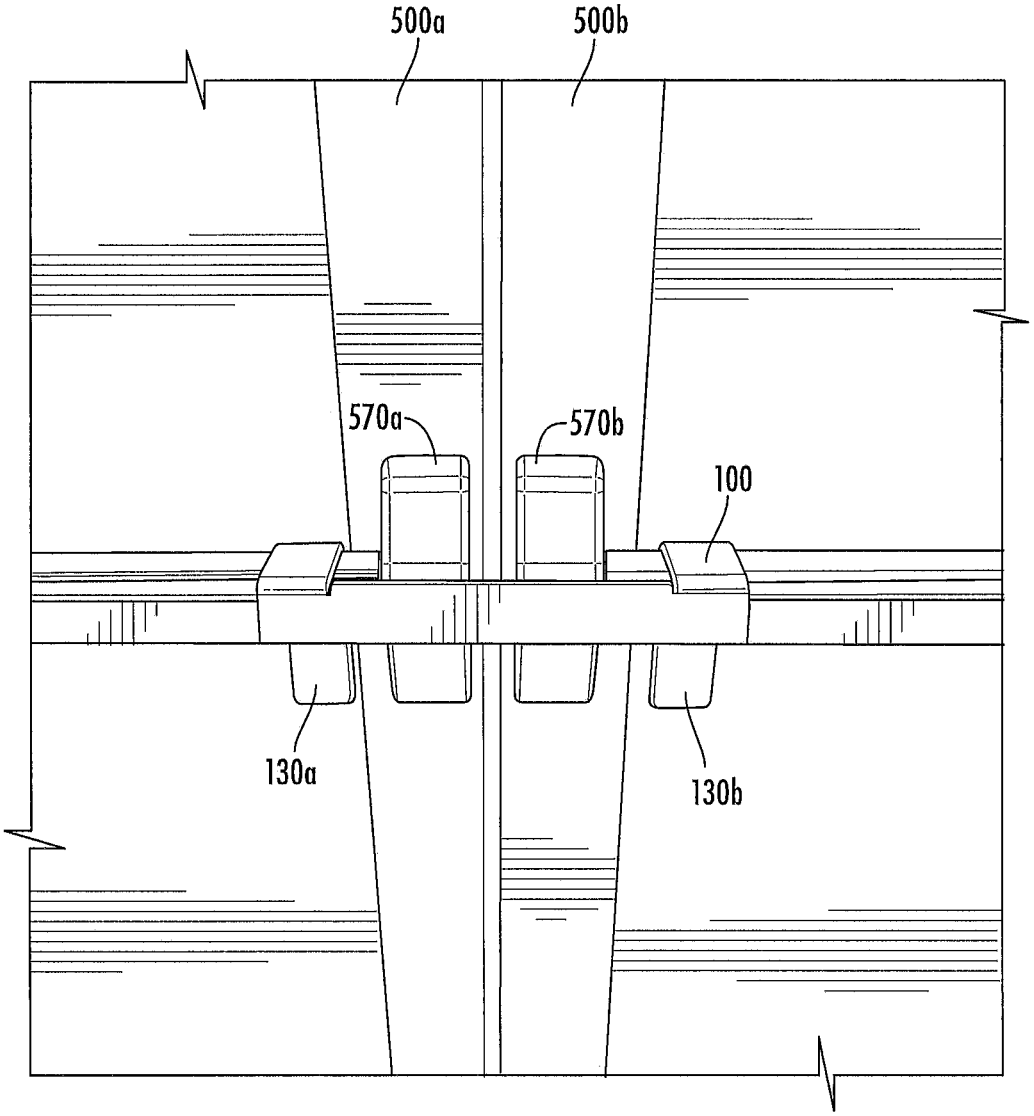
FIG. 5 is a perspective view of the security device for doors of FIG. 1 shown installed on a set of solid doors having crash bars.

Referring now also to FIG. 5 in the drawings, security device 100 shown installed in the operative mode on a pair of solid doors 500*a* and 500*b* having handle mounts 570*a* and 570*b* is illustrated. In some applications it may be necessary and/or desirable to modify mounts 570*a* and 570*b* to accommodate security device 100. For example, it may be necessary to create one or more recesses behind the crash bar or handle mounts 570*a* and 570*b* to receive door tabs 130*a* and 130*b*. Such modifications may include adding gaskets, washers, or material layers between doors 500*a* and 500*b* and mounts 570*a* and 570*b*.

Figure 6:
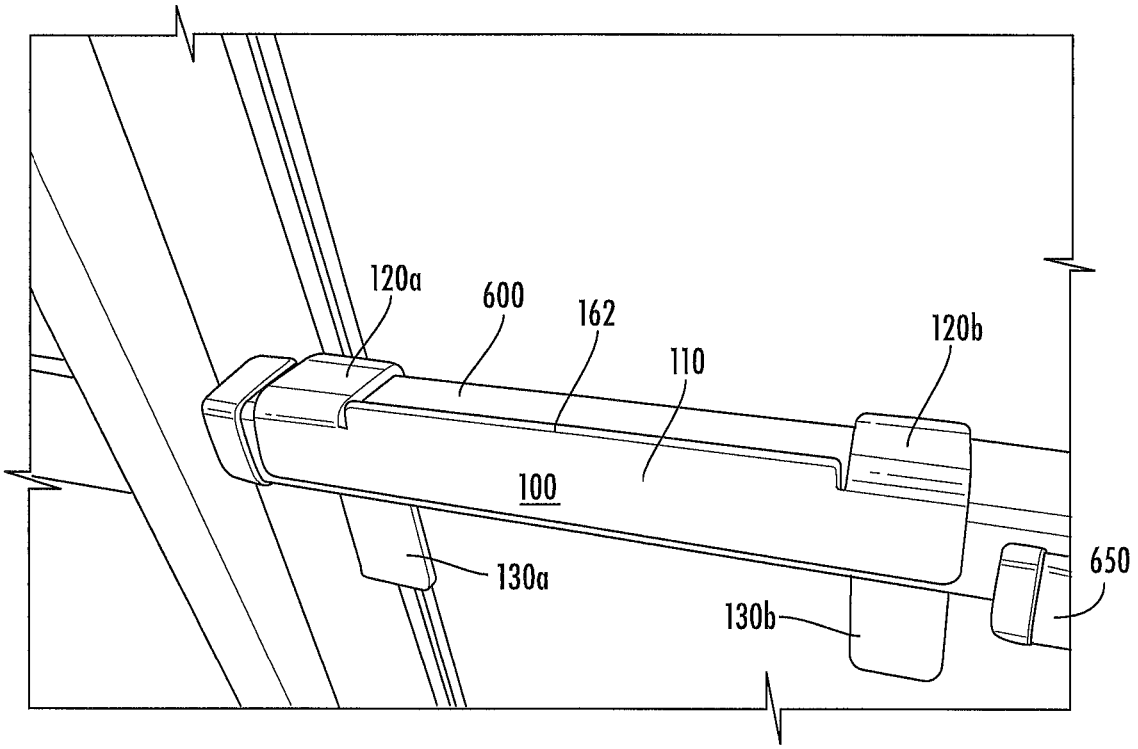
FIG. 6 is a perspective view of the security device for doors of FIG. 1 shown installed on a door having a crash bar, the security device for doors being depicted in a stowed position.

Referring now also to FIG. 6 in the drawings, security device 100 shown in a stowed position on a rail 600 of a crash bar 650 is illustrated. In the preferred embodiment, security device 100 is sized and shaped so as to be stowed in a positon on top of rail 600 and adjacent crash bar 650, such that crash bar 650 may be depressed without interference from security device 100. In an alternative embodiment, security device 100 may be stowed, such that at least a portion of security device 100 overlaps or covers a portion of crash bar 650, causing crash bar 650 to remain depressed while security device 100 is stowed.

Figure 7A:
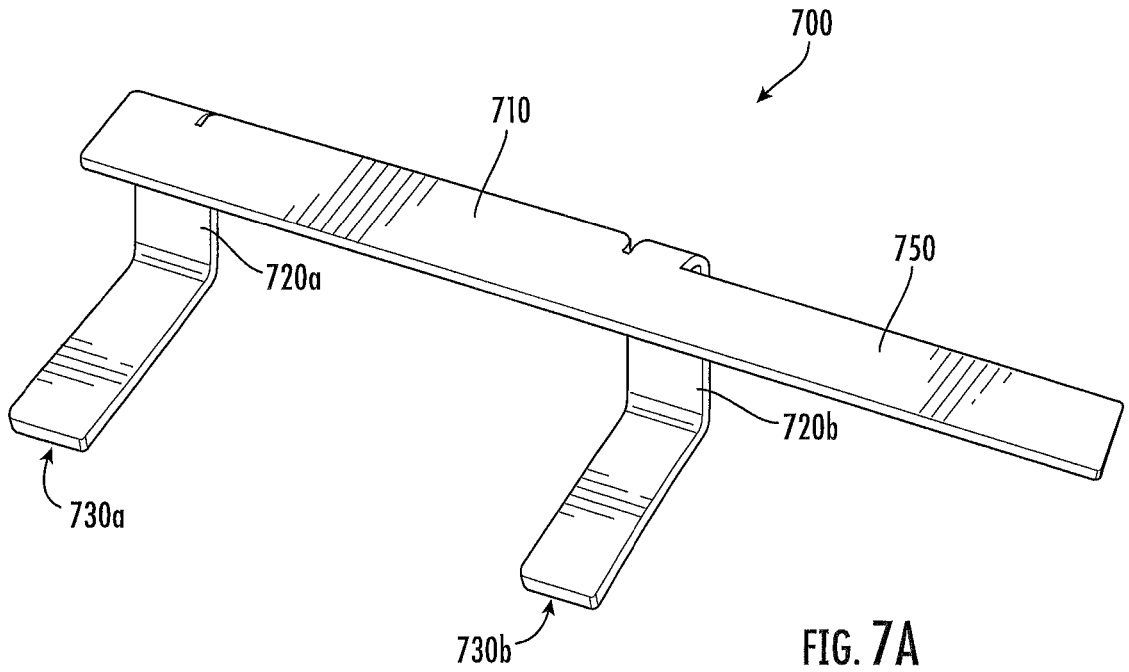
FIGS. 7A and 7B are perspective views of security devices for doors according to alternative embodiments of the present application.
Figure 7B:
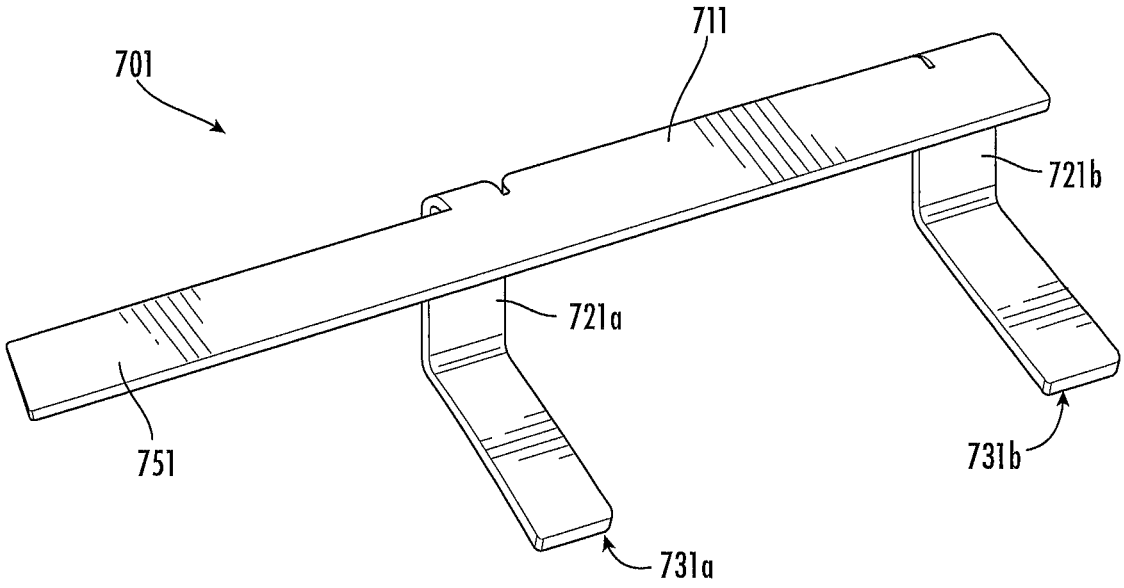

Referring now also to FIGS. 7A and 7B in the drawings, security devices 700 and 711 according to alternative embodiments of the present application are illustrated. Security devices 700 and 711 are for use with single doors. As shown in FIG. 7A, security device 700 is configured similarly to security device 100, in that security device 700 includes a front bar 710, rail supports 720*a* and 720*b*, and door supports 730*a* and 730*b*. Security device 700 further includes a horizontal extension 750 integral to the front bar 710, extending out and away from a right side of security device 700. Alternatively, horizontal extension 750 is attached using screws, bolts, welds, or other fasteners. A door on which the security device 700 is removably attached swings out, away from the building, from a left-hand door jamb. Horizontal extension 750 overlaps the right-hand door jamb, thereby preventing the door to which security device 700 is attached from being opened. In at least one embodiment, a receiving cuff (not shown) may be mounted on the right-hand door jamb to receive a portion of extension 750 and to provide further security measures. With doors that open in towards the interior of the building, extension 750 may be positioned on, the opposite side of security device 700 and may be used together with another metal cuff that is secured to the door jamb.

Likewise, as shown in FIG. 7B, security device 711 is configured similar to security device 100, including a front bar 711, rail supports 721*a* and 721*b*, and door supports 731*a* and 731*b*. Security device 701 further includes a horizontal extension 751 that extends out and away from a left side of the security device 701. Security device 701 is used with a door that swings from a right-hand door jamb, with horizontal extension 751 overlapping the left-hand door jamb. Horizontal extension 751 overlaps the left-hand door jamb, thereby preventing the door to which security device 701 is attached from being opened. Again, a receiving cuff (not shown) may be mounted on the left-hand door jamb to receive a portion of extension 751 and to provide further security measures. With doors that open in towards the interior of the building, extension 751 may be positioned on the opposite side of security device 701 and may be used together with another metal cuff that is secured to the door jamb.

It will be appreciated that security devices 700 and 701 may be adjustable in a manner similar to that described below with respect to FIG. 8. In addition, extensions 750 and 751 may extend from front bars 710 or 711, respectively; or may extend from door supports 730*b* and 731*a*, respectively.

It is important to note that while the surfaces receiving the security devices disclosed herein have been depicted as having only a single security device attached thereto, additional security devices may be attached to the same surface(s). For example, a security device having a wide width that spans more than 30%, 40%, or 50% of the width of a door may be used together with a second security device. The first, wider security device may be notched or have a lip formed along one or more interior surfaces to house or nest the second narrower security device within the first, wider security device, thereby providing additional security.

Methods for making security devices 100, 700, and 701 generally include at least three steps, such as 1) making first and second parallel cuts along a surface of a substantially rectangular solid sheet; 2) making at least a third cut parallel to a side normal to the first and second cuts to define a door support and a front bar; and 3) separating the door support from the front bar. It should also be understood that the security device may be made out of a substantially rigid material, such as a planar metal sheet or an extruded aluminum alloy. To create a door security device from a metal sheet, several cuts need to be made in a substantially rectangular metal sheet. First and second parallel cuts should be made through top and bottom facial surfaces of the rectangular metal sheet, extending from a first edge to a desired length. The first and second parallel cuts should extend to greater than or equal to three-fourths the longitudinal dimension of the rectangular metal sheet. In one embodiment, at their longest, the first and second parallel cuts leave at least one-inch of material beyond the length of the cuts. A third cut should be made normal to first and second parallel cuts through top and bottom facial surfaces and connecting the first and second parallel cuts. The third cut should extend between the first and second cuts, and should be parallel with a latitudinal edge of the rectangular metal sheet. Fourth and fifth parallel cuts may create notches that are used when folding tabs at ninety-degree angles to define two door supports that extend normal to the rail supports. Alternatively, the notches are created when making the first and second parallel cuts. Additional folds are made to define the front bar, or to separate the front bar from the rail support(s). The notches may help to define the lip, the door supports, and/or the rail supports during folding.

In at least one embodiment, the door security device is made using a strip of flat iron, angle iron, and/or metal tubing cut and welded together. For example, the first step above may include making parallel cuts in a strip of flat iron to form tabs and material strips that will be used to make the door supports and front bar of the security device. The second step above may include making a third cut to separate a piece of metal tubing into two equal portions. The cut is made along a side that will be positioned normal to the first and second cuts. Once the tubing is properly positioned, the third step above includes welding each tubing portion between the front bar and a door support to securely separate and define at least two door supports and the front bar of the security device, with or without an extension.

Figure 8:
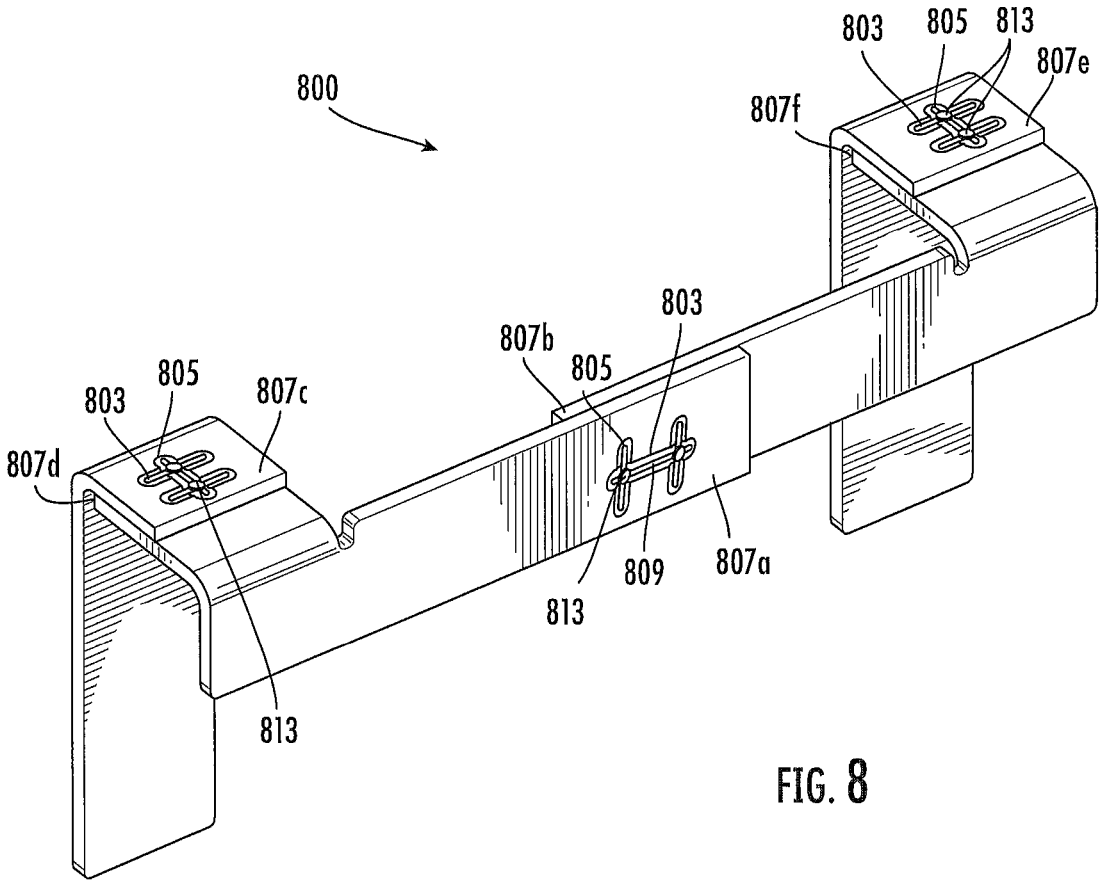
FIG. 8 is a perspective view of a security device for doors according to an alternative embodiment of the present application.

Referring now also to FIG. 8 in the drawings, a security device 800 according to an alternative embodiment of the present application is illustrated. Security device 800 includes one or more adjustable dimensions. For example, security device 800 includes one or more vertical adjustment channels 803, one or more horizontal adjustment channels 805, one or more adjustment tabs 807*a*, 807*b*, 807*c*, 807*d*, 807*e*, 807*f*, a plurality of adjustment fasteners 813, and a plurality of adjustment holes (not shown) aligned with the adjustment fasteners 813. Security device 800 is capable of at least two-dimensional adjustments, including adjustments along horizontal and vertical directions. Although adjustment fasteners 813 are depicted as hexagonal set screws, other fasteners are encompassed herein, including but not limited to, bolts, nuts, plug welds, welds, self-tapping screws, pins, and similar fasteners. Preferably, to adjust the adjustment tabs, set screws 813 are loosened, and the studs of set screws 813 are moved along horizontal or vertical slots 809 formed in the adjustment channels 803 and/or channels 805. When in the desired position, set screws 813 are tightened, securing adjustment tabs 807 together. Although the adjustment mechanism described above relies on channels, slots, and set screws, additional adjustment mechanisms are encompassed herein, including but not limited to, multiple adjustment holes, telescopic parts, dual channel or dual slot configurations, sliding brackets, sliding-interlocking-slats or grooves, and combinations thereof.

Figure 9:
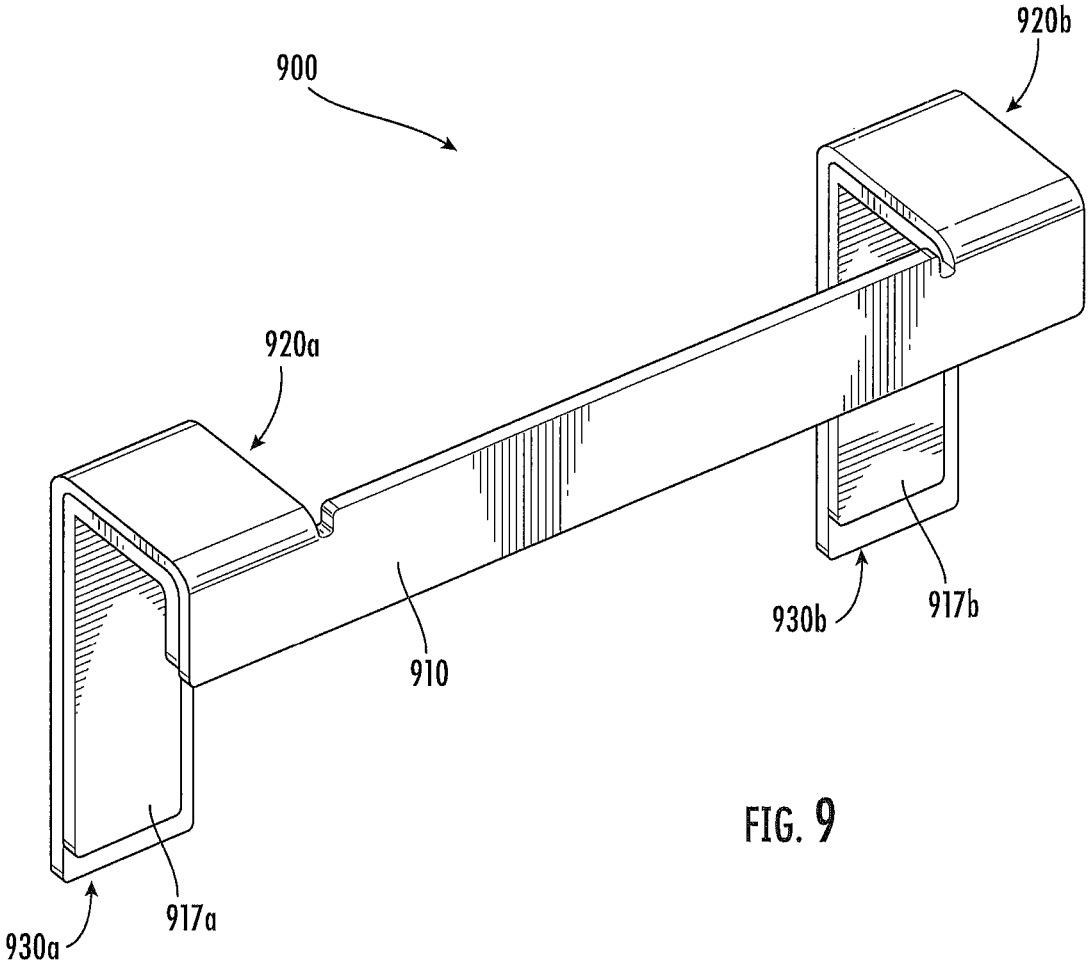
FIG. 9 is a perspective view of a security device for doors according to an alternative embodiment of the present application.

Referring now also to FIG. 9, a security device 900 according to an alternative embodiment of the present application is illustrated. Security device 900 includes padding, dimension adjusters, grippers, and/or combinations thereof. For example, security device 900 includes door pads 917*a* and 917*b* attached to door supports 930*a* and 930*b*, rail supports 920*a* and 920*b*, and a front bar 910. It is preferred that each door pad 917*a* and 917*b* be configured as single, continuous strip of flexible or elastomeric material that provides cushioning and/or additional gripping. Alternatively, each door pad 917*a* and 917*b* may be configured as multiple, discrete padding and/or gripper segments positioned in close proximity to each other and attached to respective portions of security device 900. Each door pad 917*a* and 917*b* is preferably positioned on the front, back, bottom, or both surfaces of respective portions of security device 900. Door pads 917*a* and 917*b* may be attached using a non-hardening adhesive, such as a silicon glue. Alternatively, door pads 917*a* and 917*b* may be attached using polymer-based adhesives (hardening or non-hardening), heat fusion, double-sided tape, epoxy resins, composites, screws, and combinations thereof. In yet another embodiment, instead of padding, security device 900 may be dipped in an elastomeric polymer-based coating, or otherwise treated, to provide the padding and/or grip to the surfaces of security device 900.

It is important to note that although the pads and grippers are described above as flexible or elastomeric, other materials are encompassed herein. For example, at least door pads 917*a* and 917*b* may be formed of a rigid or semi-rigid material, such as wood, metal, or plastic. In these embodiments, door pads 917*a* and 917*b* may be performing at least one of a spacing function, positioning function, a width adjustment function, and the padding/gripping function. It is important to note that door pads 917*a* and 917*b* of FIG. 9 add an additional dimension adjustment to the two-dimensional adjustment capabilities discussed relative to FIG. 8. These three-dimensional adjustment capabilities make security devices disclosed herein capable of placement on almost any type of door, and doors of any size.

It is apparent that an invention with significant advantages has been described and illustrated. Although the present application is shown in a limited number of forms, it is not limited to just these forms, but is amenable to various changes and modifications without departing from the spirit thereof.

What is claimed is:

1. A door security device for a double door having two independently operated door panels and a push bar on each door panel, wherein the push bars are offset from the door panels, each door panel having a door handle for coupling each offset push bar to the door panel, the door security device comprising:

a front bar;

at least one rail support extending away from the front bar; and at least two planar door tabs extending down from the rail support;

wherein the door tabs are configured, such that each door tab extends down between a respective door panel and the corresponding push bar when the door security device is in use, such that the door security device is held in position on the push bars with the rail support resting on a top surface of each push bar, each door tab contacting a back surface of the corresponding push bar, and the front bar contacting a front surface of each push bar;

wherein there is a distance between the door tabs, such that the door security device fits over each push bar with no interference from the door handle of each push bar; and wherein each of the the door tabs extend beyond a bottom edge of the corresponding front bar.

2. The door security device of claim 1, wherein the front bar and the rail support are formed as a single component.

3. The door security device of claim 1, wherein the front bar and the rail support are formed as separate components.

4. The door security device of claim 1, wherein the at least one rail support comprises:

two rail supports.

5. The door security device of claim 1, wherein the front bar, each rail support, and each door tab are integrally formed together.

6. The door security device of claim 1, wherein the front bar is adjustable.

7. The door security device of claim 1, wherein the rail support is adjustable.

8. The door security device of claim 1, further comprising:

one or more door pads disposed on the front bar, or the at least one rail support, or the one or more door tabs, such that the one or more door pads prevent the front bar, the at least one rail support, or the one or more door tabs from damaging the door panel or the push bar.

9. A method of securing a double door having two independently operated door panels and a push bar on each door panel, wherein the push bars are offset from the door panels, each door panel having a door handle for coupling each offset push bar to the door panel, the method comprising:

providing a door security device having a front bar, at least one rail support extending away from the front bar, and two planar door tabs extending down from the rail support, each of the door tabs extending beyond a bottom edge of the front bar; and installing the door security device on the double door by placing the door security device on a top edge of the push bars, inserting one of the door tabs down between the door panel and the push bar of one door, and inserting the other door tab down between the door panel and the push bar of the other door, such that the door security device is held in position with the rail support resting on the top edge of the push bars, each door tab contacting a back surface of the corresponding push bar, and the front bar contacting a front surface of each push bar; and wherein there is a distance between the door tabs, such that the door security device fits over each push bar with no interference from the door handle of each push bar.

* * * * *